United States Patent [19]

Pomento

[11] Patent Number: 4,862,653

[45] Date of Patent: Sep. 5, 1989

[54] BUILDING FOR PARTICULATE MATERIAL

[76] Inventor: Patrick G. Pomento, 802 W. Embargo St., Rome, N.Y. 13440

[21] Appl. No.: 259,169

[22] Filed: Oct. 18, 1988

[51] Int. Cl.[4] ..... E04B 7/00

[52] U.S. Cl. ..... 52/93; 52/642

[58] Field of Search ..... 52/293, 294, 295, 642, 52/90, 93, 299, 639, 642, 643

[56] References Cited

U.S. PATENT DOCUMENTS

| | | | |
|---|---|---|---|
| 1,346,229 | 7/1920 | Mecham . | |
| 1,585,254 | 5/1926 | Lund et al. | 52/295 X |
| 1,764,001 | 6/1930 | Blanchard | 52/293 X |
| 1,929,226 | 10/1933 | Watkins . | |
| 2,211,348 | 8/1940 | Davidson . | |
| 2,288,193 | 6/1942 | Horn et al. . | |
| 2,396,828 | 3/1946 | Carpenter | 52/293 X |
| 2,573,987 | 11/1951 | Sage | 52/293 X |
| 3,343,321 | 9/1967 | Axelsson . | |
| 3,346,999 | 10/1967 | Johnson . | |
| 3,820,292 | 6/1974 | Fitzpatrick . | |
| 4,285,174 | 8/1981 | Knight . | |
| 4,483,117 | 11/1984 | Underhill et al. . | |
| 4,627,208 | 12/1986 | Esposito . | |

FOREIGN PATENT DOCUMENTS

| | | | |
|---|---|---|---|
| 0000425 | 6/1981 | Japan | 52/293 |

*Primary Examiner*—Carl D. Friedman
*Assistant Examiner*—Lan Mai
*Attorney, Agent, or Firm*—Wall and Roehrig

[57] ABSTRACT

A building that includes a plurality of spaced apart pilasters vertically disposed, that are raised above ground level to a given elevation wherein the top of the pilasters lie in a common horizontal plane. A barrier wall is erected on the inside of the pilasters using heavy beam members. Wooden truss members are seated on top of the pilasters. Each truss member contains a vertically disposed column section and an upwardly pitched roof beam section. The crown of each truss roof section is attached to the crown of at least one other truss member. The truss members are covered with sheeting to enclose the building above the top of the barrier wall.

22 Claims, 5 Drawing Sheets

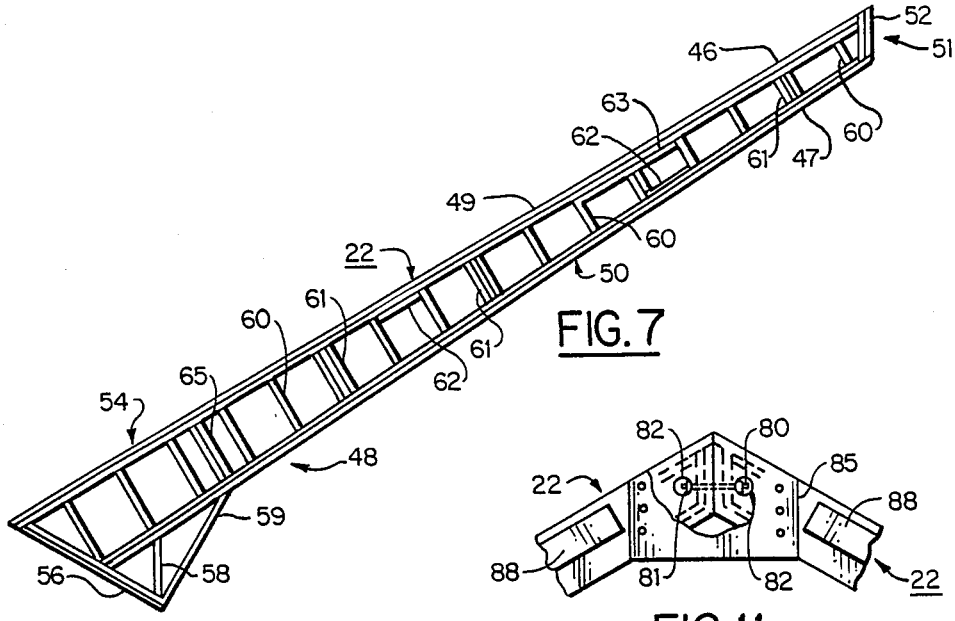
FIG. 7
FIG. 11
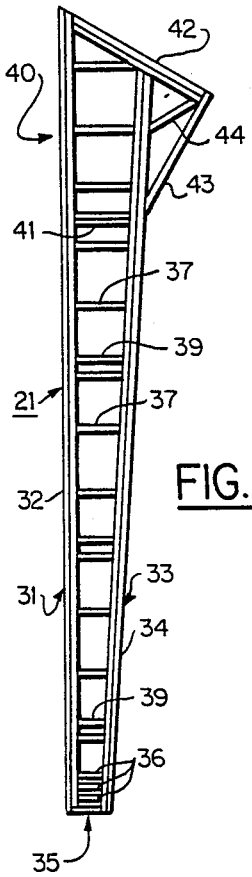
FIG. 6
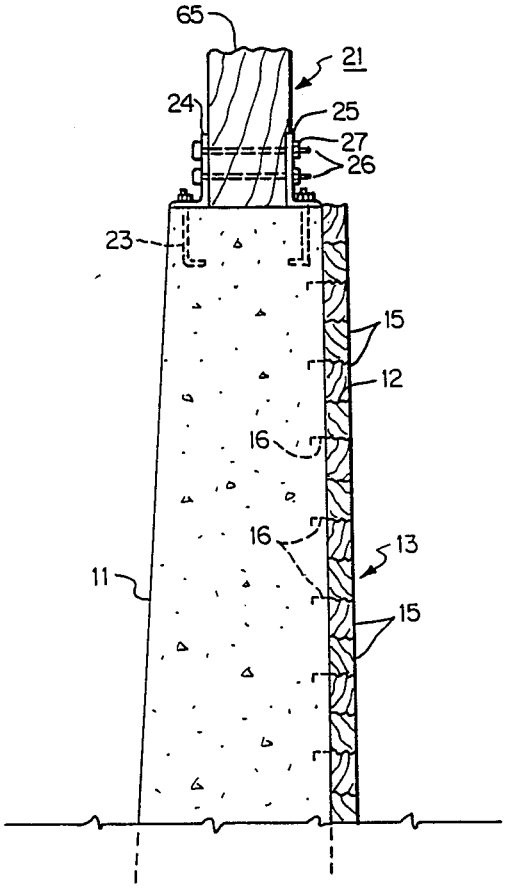
FIG. 5

FIG. 10
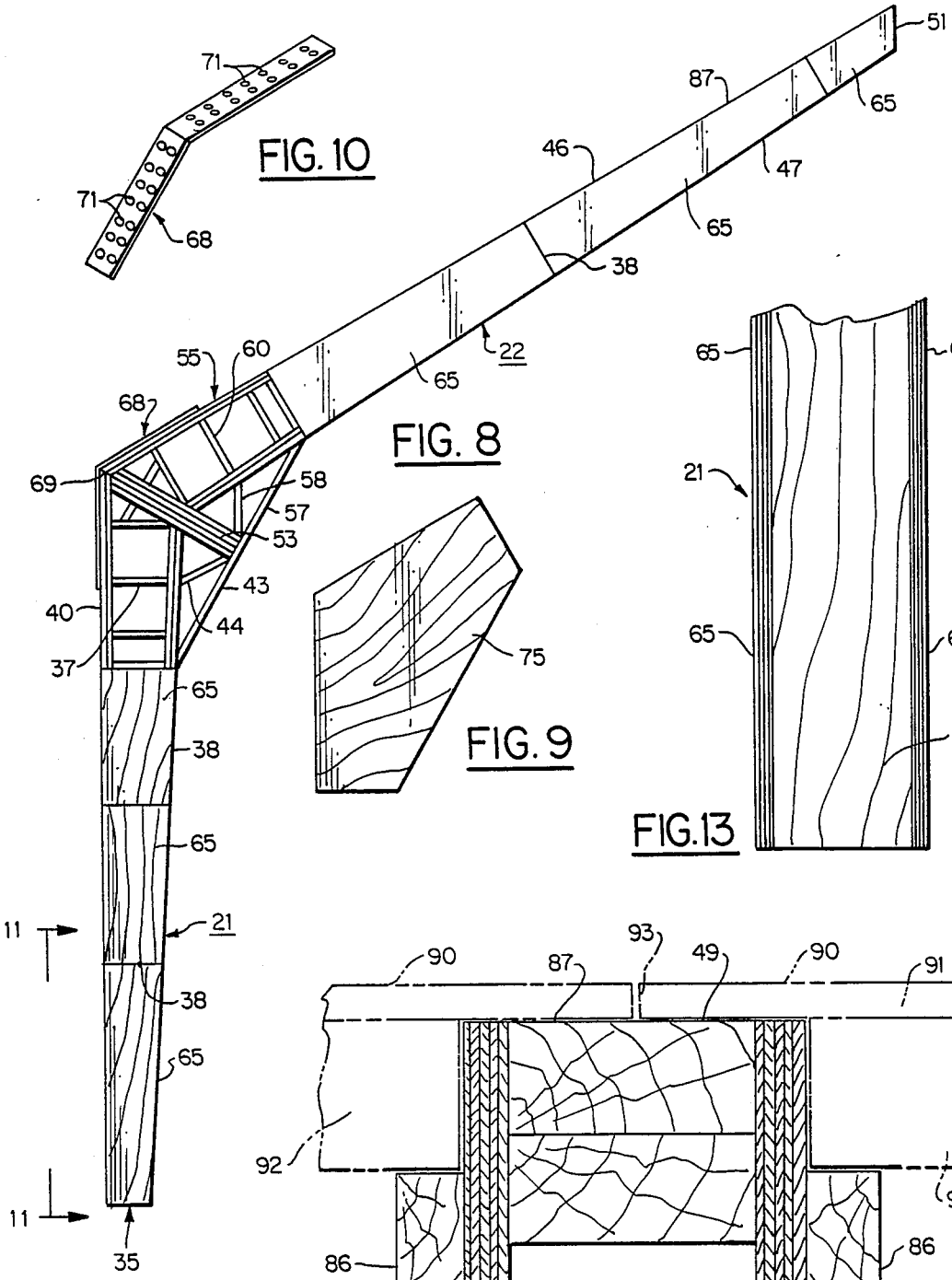
FIG. 8
FIG. 9
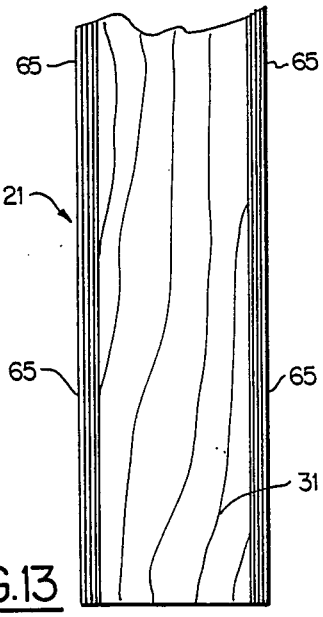
FIG. 13
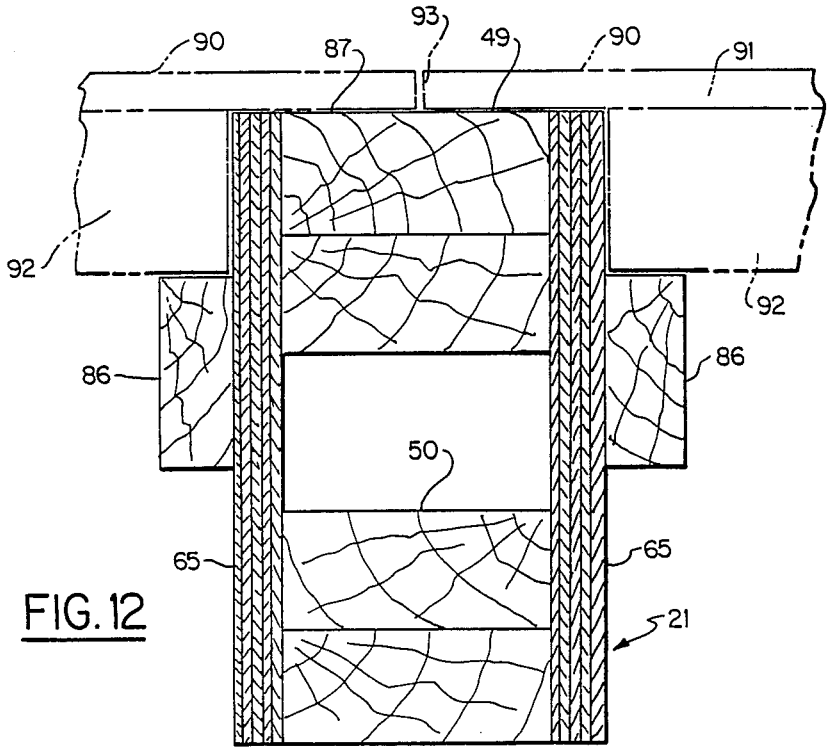
FIG. 12

BUILDING FOR PARTICULATE MATERIAL

BACKGROUND OF THE INVENTION

This invention relates to a building structure and, in particular, to a building that is ideally suited for storing particulate material.

In U.S. Pat. Nos. 3,820,292 to Fitzpatrick and 4,285,174 to Knight there are disclosed cone shaped buildings that are specifically designed to house road sand or salt. These buildings, because of their shape, are difficult to erect. Loading and unloading material into and out of the building is also sometimes difficult. The inside walls of the buildings typically consist of thin plywood sheeting that can deteriorate rapidly when salt or wet sand is stacked thereagainst. The relatively weak walls of the structure, as well as the framing for the building are exposed to any heavy equipment that might be working inside the structure. If struck by this type of equipment, the walls can be easily punctured or the superstructure seriously weakened. As a consequence, many of these cone shaped buildings are now equipped with relatively expensive conveyors and the like, designed to move material in and out of the building so that heavy mobile equipment is not required to enter the structure. Special handling equipment is expensive and introduces additional loading problems.

SUMMARY OF THE INVENTION

It is therefore an object of the present invention to improve building structure, and in particular, buildings that are used to store particulate materials.

Another object of the present invention is to provide a building in which heavy mobile equipment can safely operate without danger to the integrity of the building structure.

Yet another object of the present invention is to provide a building in which particulate materials such as road sand and salt can be stored without posing a danger to the building structure.

These and other objects of the present invention are attained by means of a building that includes a plurality of spaced apart pilasters vertically disposed, that are raised above ground level to a given elevation wherein the top of the pilasters lie in a common horizontal plane. A barrier wall is erected on the inside of the pilasters using heavy beam members. Wooden truss members are seated on top of the pilasters. Each truss member contains a vertically disposed column section and an upwardly pitched roof beam section. The crown of each truss roof section is attached to the crown of at least one other truss member. The truss members are covered with sheeting to enclose the building above the top of the barrier wall.

In one form of the invention, the building is rectangular in form and has an oversized entrance in the front wall to permit dump trucks and other similar types of mobile loading and unloading equipment to move freely in and out of the building. The heavy barrier wall is placed inside the pilaster to protect the building structure from equipment operating inside the building. The barrier is also capable of resisting the weight of particulate material that might be placed thereagainst. Preferably, the barrier wall is formed of a material that will not readily deteriorate or weaken when placed in contact with road salt, wet sand and the like.

BRIEF DESCRIPTION OF THE DRAWING

For a better understanding of these and other objects of the present invention, reference is had to the following detailed description of the invention which is to be read in conjunction with the accompanying drawings, wherein:

FIG. 5 is a side elevation in partial section showing the column section of a truss member anchored to a support pier.

FIG. 6 is a side elevation of the column section of the present truss member with the side panels removed to show the structural frame of the section;

FIG. 7 is also a side elevation of the upwardly pitched roof beam section of the present truss member with the side panels removed to show the structural frame of the panel;

FIG. 8 is a side elevation showing the two sections of the truss member assembled and the sections partially covered with plywood sheeting;

FIG. 9 is a side elevation of a corner panel used to cover the corner section of the roof truss shown in FIG. 6;

FIG. 10 illustrates a corner strap that is placed over the outside edge of the truss corner as shown in FIG. 6;

FIG. 11 is a partial side elevation showing the crown section of one truss member being joined to the crown section of a second truss member to complete a roof support assembly;

FIG. 12 is an enlarged section taken along lines 10—10 in FIG. 2; and FIG. 13 is an enlarged end view taken along lines 11—11 in FIG. 6.

DETAILED DESCRIPTION OF THE INVENTION

Figure 1:
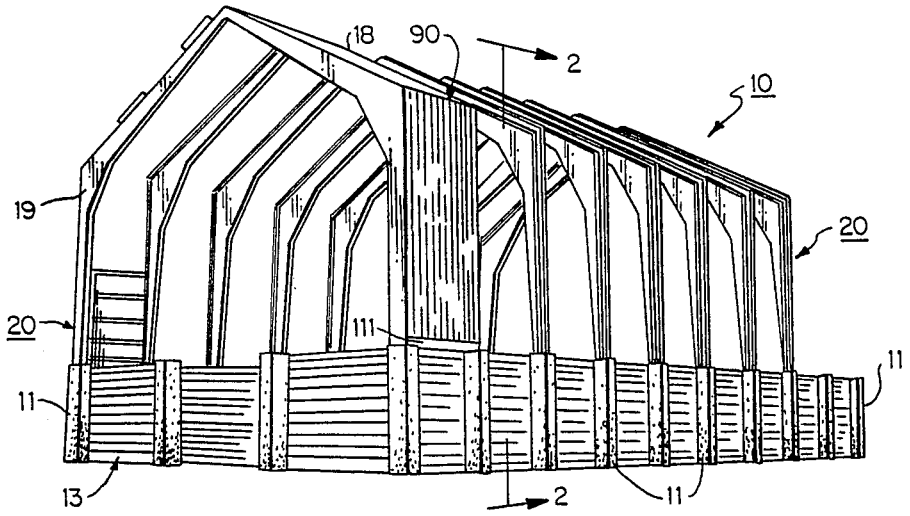
FIG. 1 is a perspective view of a building incorporating truss members embodying the teachings of the present invention.

Referring now to the drawings, there is shown in FIGS. 1-4 a partially erected building 10 containing a truss assembly embodying the teachings of the present invention. The building is specifically designed to store particulate material, such as salt or sand of the type generally spread over icy road surfaces during the winter months to melt the ice and thus reduce driving risks. It should become apparent from the description below that the building, however, may be used for other purposes. The building includes a series of spaced apart raised concrete pilasters 11—11 that are poured into cored holes formed in the ground. In this embodiment of the invention the pilasters are erected in a rectangular pattern which defines the perimeter of the building. The top surface of the pilasters are all raised to the same elevation so that they lie in a common plane. A barrier wall 13 is placed inside the pilasters and is raised from ground level to the same elevation as the pilasters. The wall is formed of pressure treated beams 15—15 that are stacked one upon the other as illustrated in FIG. 5. A tongue and groove joint 12 is furnished between the abutting beams to strengthen the wall. Galvanized metal inserts 16—16 having dovetails that are anchored in each of the pilasters and are arranged to pass through the joints between adjacent timbers. The terminal end of each insert is bent into parallel alignment with the inner face of the wall and is nailed to a timber to hold the wall in place and provide additional strength.

The wooden beams forming the barrier wall may be replaced with beams made of concrete or any other similar construction that have a high enough strength to protect the pilasters from equipment that might be operating in the building. In addition, the beams should also be able to withstand deterioration when materials such as salt or wet sand is piled thereagainst. To this end, the wooden beams are pressure treated to prevent the wood from rotting when contacted by salt and/or water.

Figure 2:
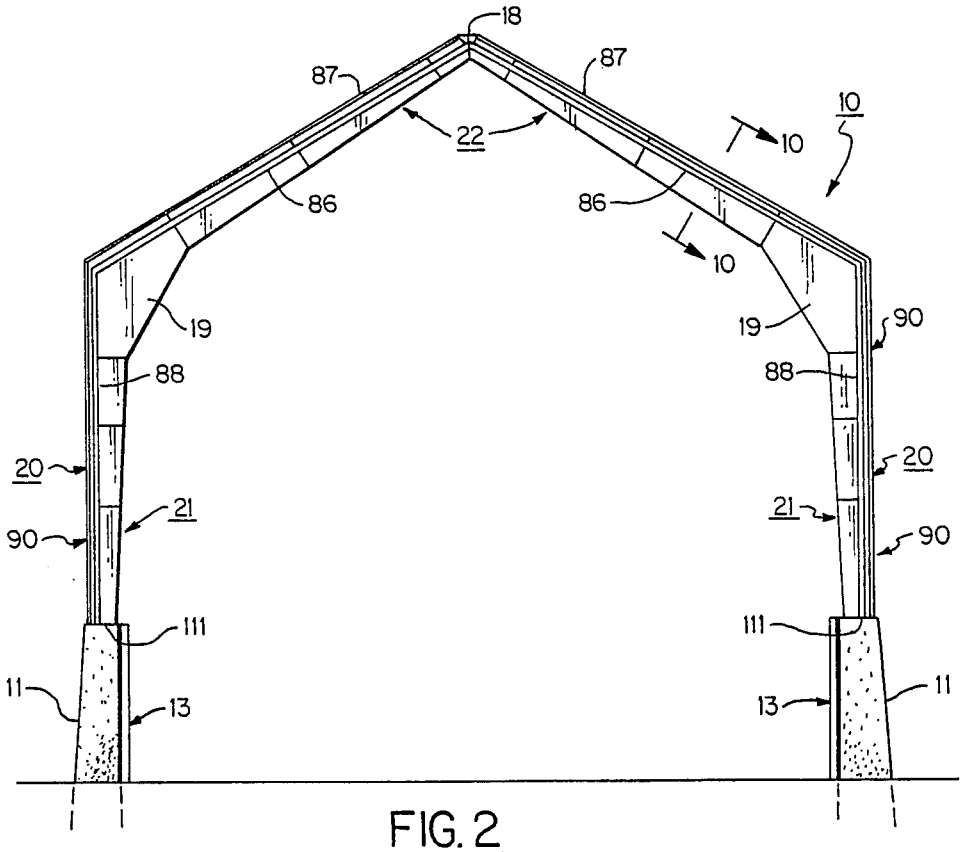
FIG. 2 is an enlarged end view of the building shown in FIG. 1 further illustrating the truss member of the present invention.

A roof truss member designated 20 is seated in an upright position upon each of the raised concrete pilasters in the side rows. Each truss member includes a vertically disposed column section 21 and an upwardly pitched roof beam section 22 which, as will be explained in greater detail below, is connected to the top of the column section to form a knee joint like corner depicted generally at 19 (FIG. 2). The pilasters are arranged as shown in FIGS. 1 and 2 in spaced alignment along the opposing side walls of the building. The truss members mounted upon opposing side wall pilasters are arranged to come together in abutting contact at their crowns with the crowns describing the peak 18 of the roof. As can be readily seen in FIG. 1, the present construction eliminates the need for horizontal beams, purlin joists, or the like that are typically employed in more conventional structures for joining the truss members in assembly. The entire area inside the building is thus free from the floor level to the roof level of any structural element that might impede the maneuvering of heavy or bulky equipment operating inside the building.

As illustrated in FIG. 5, the column section of each truss member is securely anchored by anchor bolts to the top of a supporting pilaster by means of opposing angle plates 24 and 25. The raised arms of the plates are connected to the base of the column section by means of through bolts 26. A series of J-shaped anchor bolts 28 are cast into the top section of the pilaster as shown. The raised portion of each bolt is arranged to pass through an enlarged hole (not shown) formed in the base legs of the angle plates, and a nut 27 is threaded onto the bolt and tightened against the base leg thus securing the truss member in an upright position.

Each of the two sections making up the truss member contains a hollow box-like frame that is assembled as by gluing together standard size pieces of lumber. These pieces of lumber can be either 2×4 members or 2×8 members which are cut to any desired length. The side walls of the frames are closed in final assembly by means of plywood cover panels 65—65 (FIG. 8). The two sections of the truss are prefabricated under closely controlled tolerances at the factory and are shipped to the building site for final assembly. All joints between the various wooden components are accurately cut and closed at the factory using suitable high strength bonding material. As a result, each truss section leaving the factory, although made of wood, represents a unitized structure capable of withstanding extremely high external loads.

Turning now to FIGS. 6–13, there is shown a frame assembly 30 of the column section 21. As noted, all frame members are cut from standard size pieces of lumber having the same cross sectional dimensions. The frame includes a vertically disposed outer chord 31 which consists of two studs glued in face-to-face contact along their respective lengths. The studs are mounted edgewise in the frame with the chord forming the outside wall 32 of the column.

The inside wall of the column is similarly formed by inner chord 33 made up of two studs glued in face-to-face relationship. The inner chord which forms the inside wall 34 of the column, is spaced apart from the outer chord and is set at an angle so that the width of the column increases uniformly from the base 35 of the column toward the top of the column. The base of the column is a thick wooden plate generally referenced 35 that is made up of a series of wooden blocks that are glued together in a stacked configuration. The plate is perpendicularly aligned in regard to the vertically disposed inner chord. The plate is thick enough so that the through bolts 26 holding the column to the anchoring angle irons will pass therethrough. A series of horizontally disposed internal ribs 37—37 are mounted between the two chords and provide additional strength to the column. The rib thickness is increased in any region where the side wall cover panels will be joined in abutting contact as for example, at joints 38—38 (FIG. 8). These multiple ribbed members shall be referred to herein as "splices" and are depicted in FIG. 6 by the reference number 39. In this case, the splices are formed by gluing three ribs together in face-to-face contact.

The top portion of the column section includes a bottom corner subsection 40 that extends upwardly from a double splice 41 to the top portion of the column. The bottom corner subsection includes an elongated flange 42 that forms the upper wall of the column section The flange is inclined downwardly from the outer chord and extends inwardly beyond the inner chord of the column. A brace member 43 is secured at one end to the extended portion of the flange and at the other end to the inner chord at a point adjacent to the previously noted double splice 41. A web 44 is connected between the inside corner formed between the brace member and the flange and the inner chord of the column section to provide added rigidity and stiffness to the bottom corner subsection. In this particular construction, the flange member is again fabricated by gluing top studs together in a face-to-face configuration. The brace and web members, however, are fabricated from single studs because of different load bearing considerations.

FIG. 7 shows the frame 48 of the pitched roof beam section of the truss member. Here again, the frame components are accurately cut in the factory to close tolerances and are glued together prior to shipment to provide a unitized high-strength assembly. The roof beam frame 48 includes an outer chord 49 that forms the outside wall 46 of the section and a spaced apart inner chord 50 that forms the inside wall 47 of the section. The inner chord is inclined so that the width of the roof beam section increases uniformly from the upper ends 51 towards its lower end. A vertically disposed crown member 52 consisting of two glued together studs is situated at the terminal end of the beam, the purpose of which will be described in greater detail below.

The roof beam section of the column also includes a top corner subsection 54 that encompasses the lower end of the roof beam section. The top corner subsection 54 includes an elongated flange 56 that extends inwardly at an angle from the upper chord 49 to a point beyond the lower chord. The beam flange 56 is coextensive in length with the column flange member 42. The two flange members are brought together in final assembly to form an elongated corner connection 53 illustrated in FIG. 9. The corner subsection of the roof beam further includes a brace member 57 and a web 58 that are bonded to the roof beam.

As further illustrated in FIG. 7, the inner and outer chords of the roof beam section are extra strength members that are formed by gluing together studs in face-to-face contact. Ribs 60—60 are mounted at intervals between the chords as well as a plurality of triple thickness splices 61—61 in those regions where the side wall sheeting 65—65 (FIG. 8) forms a joint 38. In addition, longitudinal splices 62 and 63 are provided along the inside of the chords behind joints formed along the chords. A double splice 65 is also provided which defines the inner boundary of the top corner subsection 54. In this section, all ribs are mounted perpendicular to the upper chord 49.

The column and beam sections are partially enclosed at the factory by gluing plywood cover panels 65—65 over the two section frames. As noted, all joints between panels occur over a splice so that the end portions of the panels can be securely glued to the frame. The two corner subsections 40 and 54, however, remain uncovered until such time as the two sections are joined together at the erection site. At the time of final assembly, the two elongated flange members 42 and 56 are aligned in abutting contact as shown in FIG. 8 and the flanges are then bolted tightly together to securely attach the roof beam section to the column section. When the two sections are assembled, the brace members 43 and 57 are brought into coplanar alignment to form an elongated bracket that helps to support the angled roof beam upon the column.

The elongated connection 53 (FIG. 8) between the column and the roof beam occurs along a line of maximum moment and therefore the elongated flange members and the brace members and not the bolt carry the entire load in this corner region.

A metal tension plate is connected over the outside of the corner 69 formed between the two sections. The plate is secured in place by nailing, lagging or wood screwing it to the adjacent outer chords of the column and roof sections. Holes 73—73 are provided in the strap in correct quantities and sizes to provide adequate shear connectors for the tension in this member. The tension in this member is determined by span, height, dead load, snow load and wind load and must be calculated to meet existing conditions of the location of the building.

After the column has been joined to the roof section, the two adjacent corner subsections are closed by gluing a corner panel 75 (FIG. 9) over the corner on either side of the assembled truss member. The grain of the cover panels is arranged so that it runs generally perpendicular to the elongated flange members. The remaining cover panels are arranged so that the grain of the panels run lengthwise along the sections. By so aligning the panels, and securely gluing them to the section frames, the panels serve to unitize the entire structure and provide a maximum amount of strength to the truss.

Prior to hoisting a truss member into place upon a support pilaster, the truss member is attached at the crown to a companion truss as shown in FIG. 11. The opposing crown members are aligned in abutting contact as shown using a single bolt 80 that is passed through the adjacent crown members and locked in place using nut 81. Access ports 82—82 are provided in the adjacent roof beam panels to permit insertion and tightening of the bolts. A crown plate 85 is placed over the crown joint formed by the abutting roof beam sections and is fastened to the sections using screws, nails or the like. The crown plate helps keep the crown joint tightly closed, however, because of the construction of the truss member, it is not required to resist any external loading.

Leger strips 86 (FIG. 12) are bonded to the opposing side walls of the roof beam section a predetermined distance from the top surface 87 of the roof beam section. Similar legers 88—88 (FIG. 2) are also bonded to the opposing side walls of each column section. The legers provide additional strength to the sections and also furnish seats upon which sheeting is attached.

As illustrated in FIG. 12 the sheeting consists of individual units 90—90 that include an elongated sheet 91 of plywood, pressed fiber board or the like. A series of joists 92 are glued to the back of each sheet that are arranged to rest in assembly upon the leger strips carried by adjacent truss members. Adjacent sheets 91—91 are further adapted to pass over the top of the truss members and form a tight joint 93 that extends along the length of the outer chord of the covered section. Again, the joints between the sheeting units and the contacted truss surfaces can be closed by gluing to provide a tight weather resistant closure.

Figure 3:
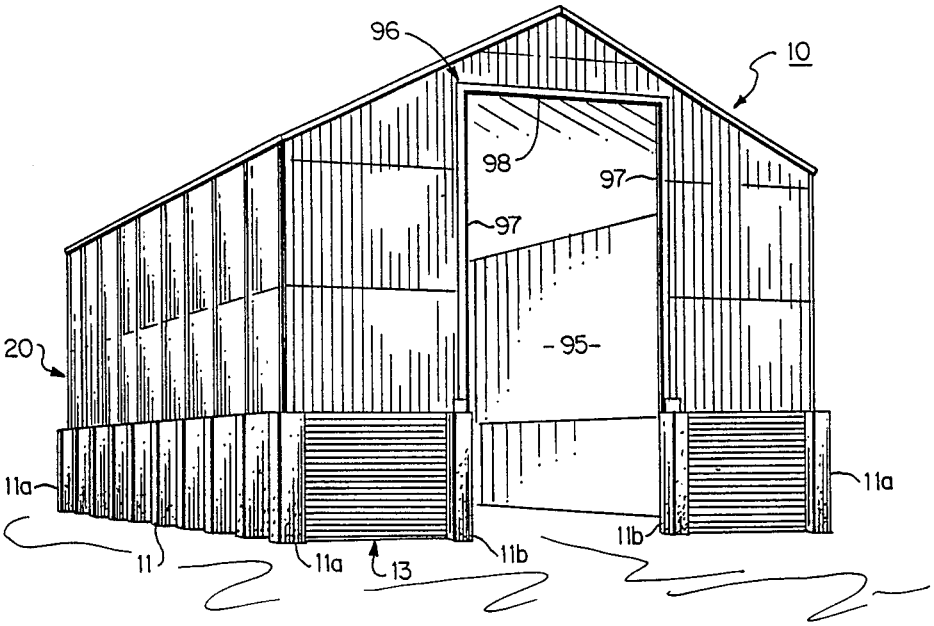
FIG. 3 is a further perspective view showing the front entrance to the building.
Figure 4:
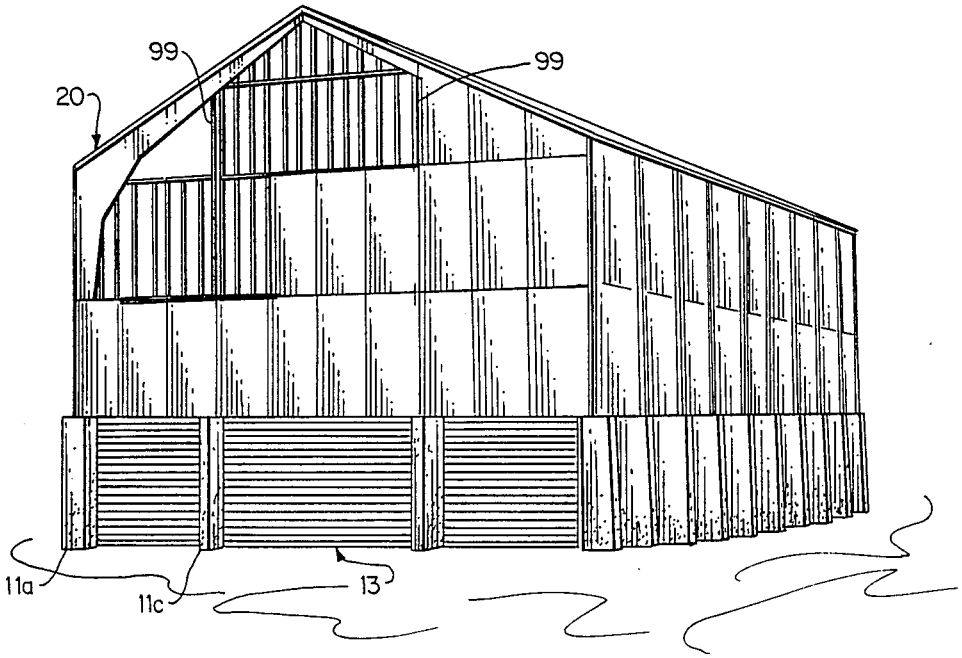
FIG. 4 is a perspective view showing the rear wall of the building.
Figure 14:
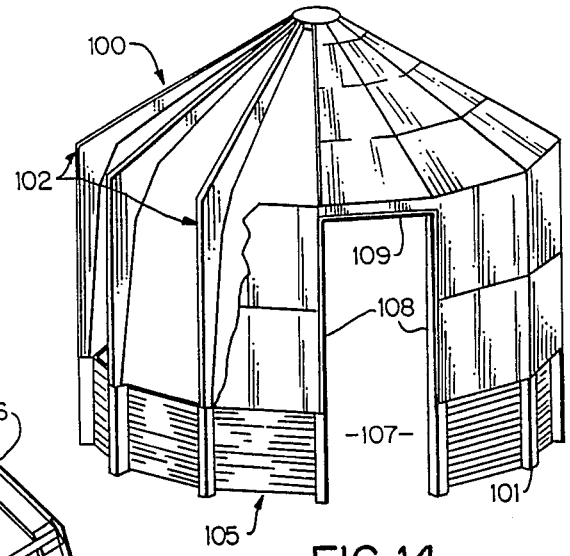
FIG. 14 is a perspective view of a second embodiment of the invention showing a building having a round configuration.

As seen in FIGS. 3 and 4, the front and rear walls of the rectangular building structure are covered with similar sheeting units that are attached to a suitable frame work (not shown) behind the units. The front wall of the building includes a pair of end pilasters **11*a* and two inner pilasters 11*b*. The barrier wall 13 is extended along the front of the building between the end pilasters 11*a* and the inner pilasters 11*b*. A wide entrance way 95 is provided, however, between the two inner pilasters through which trucks and other types of large vehicles can freely enter and leave the building. A door frame 96 having a pair of vertical beams 97—97 and an upper crossmember 98 is mounted upon the inner pilasters as shown in FIG. 3**. The vertical beams are anchored upon the top of the supporting pilasters in the same way that the truss members are anchored. The frame extends upwardly, almost to the roof of the building, to provide an extremely tall entrance way that allows dump trucks to enter and leave the building with their dump bodies in a raised position.

The back wall of the building, like the front wall, includes a pair of end pilasters **11*a* and a pair of inner pilasters 11*c*. Here, however, the barrier wall 13 is arranged to entirely close the area between the pilasters. A pair of vertical studs 99—99** are anchored upon the inner pilasters and extend upwardly to the roof beams carried by the rear truss members of the structure.

Figure 15:
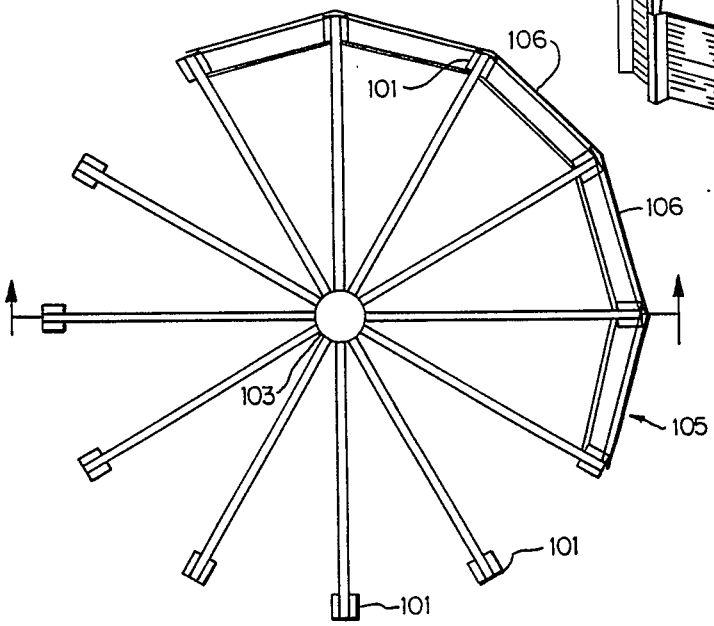
FIG. 15 is a partial top view of the building shown in FIG. 14 with portions broken away.
Figure 17:
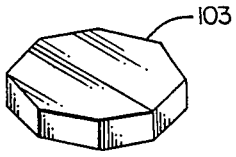
FIG. 17 is an enlarged perspective view showing the crown block used to join the truss member in the building shown in FIG. 14.
Figure 16:
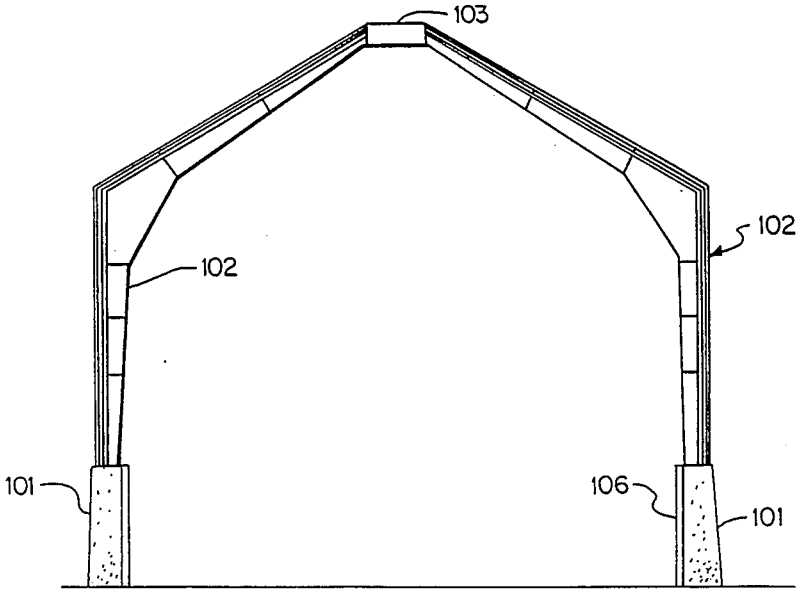
FIG. 16 is a view taken along lines 15—15 in FIG. 15.

Turning now to FIGS. 14–17 there is shown a second embodiment of the invention wherein the teachings of the present invention are used to construct a generally circular structure 100. As illustrated in FIG. 15. the pilasters 101—101 are set into the ground in a circular pattern so that they are spaced along the circumference of a common circle. Wooden truss members 102 constructed as described above are anchored upon the top of each pilaster and the crown of each truss member is secured to a commonly shared crown block 103 (FIG. 17) that is centered upon the axis of the circle described by the pilasters. A barrier wall 105 is mounted against the inside of the pilasters with the wall being made up of individual straight sections 106 that run between adjacent pilasters. Here again, the barrier wall is constructed of horizontal beams that are stacked one upon the other to the height of the pilasters. Tongue and groove joints are provided between the beams and the beams are attached to the pilasters as described above.

An entrance way 107 is provided between two adjacent pilasters. The entrance way includes a pair of vertical beams 108—108 and a cross beam 109 which passes just below the corner section of the truss member. The height and width of the entrance way is sufficiently large to permit ready access of the bulky equipment to the interior.

Referring back to FIG. 2, an air space 111 is normally furnished between the top of the barrier wall 13 and the sheeting units 90 covering the outside of the truss members. Accordingly, air can be freely exchanged between the inside of the building and the surrounding ambient. This exchange of air may be extremely desirable when certain materials are to be stored in the building. Alternatively, a partition (not shown) can be mounted on top of the adjacent pilasters to close these openings and thus more completely enclose the building.

While this invention has been explained with reference to the structure disclosed herein, it is not confined to the details set forth and this application is intended to cover any modifications and changes as may come within the scope of the following claims.

What is claimed is:

1. A building for housing particulate material or the like that includes a plurality of equally spaced vertically disposed pilasters that are secured in the ground, each pilaster being raised to an elevation so that the top surface of each pilaster lies in a common horizontal plane, a barrier wall attached to adjacent pilasters, said barrier wall extending upwardly from the ground to the top of the pilasters, a truss member mounted upon the top of each pilaster having a vertically disposed column section and an upwardly and inwardly pitched roof section that terminates with a crown, said roof beam section being connected to the column section at a commonly shared corner by a connecting manner, each truss member being attached at its crown to the crown of at least one other truss member, said connecting means including a flange means extending from the outside of the corner beyond the inside of said corner and a brace means mounted between the two sections inside the corner which is attached to the extended end of said flange means for supporting the truss at said corner, and sheeting means secured to the truss member for enclosing the building over the barrier wall.

2. The building of claim 1 wherein the pilasters are equally spaced about the circumference of a circle and the crown of each truss member is joined to the crown of the remaining truss members by a common crown block.

3. The building of claim 2 wherein each truss member includes a hollow wooden box frame that is covered by plywood panels and wherein the column and the roof beam sections are connected at a corner by a commonly shared elongated flange means that extends inwardly between the sections beyond the inside of said corner.

4. The building of claim 3 that further includes a door means situated between two adjacent pilasters that extends upwardly from the ground to an elevation equal to the elevation of said corner.

5. The building of claim 1 wherein said barrier wall is formed of horizontally disposed beams stacked one on top of the other on the inside of said pilasters and further including locking means anchored in the pilasters that pass through the joints between adjacent beams and being attached to the outside face of the beam members.

6. The building of claim 5 whereby the joint between adjacent beam members includes a tongue carried by one adjacent member which is received in a groove formed in the other adjacent member.

7. The building of claim 6 wherein said beam members are wooden timbers.

8. The building of claim 6 wherein said beam members are cast from concrete.

9. The building of claim 6 wherein each truss member further includes leger strips mounted upon opposite side walls thereof, said strips being parallel with the outside end wall of the truss and recessed inwardly from said end wall a predetermined distance and sheeting units secured to said leger strips.

10. The building of claim 1 wherein said pilasters are cast concrete elements and which further includes anchor means secured in the top of each pilaster by bolt means that are cast into said pilaster.

11. A building for housing particulate material that includes a plurality of vertically disposed pilasters that are secured in the ground and which are raised to the same elevation whereby the top surface of each pilaster lies in a common horizontal plane, said pilasters being mounted in equal spaced alignment in two opposing side rows and opposing front and rear rows so that the front and rear rows each share a corner pilaster with each of the side rows, a barrier wall attached to the pilasters that extends upwardly from the ground to the top of the pilasters, a truss member mounted upon the top of each pilaster in the opposing side rows, each truss member having a vertically disposed column section and an inwardly and upwardly pitched roof beam section are joined by a connecting means to form a corner, said roof beam section being that attached at its crown to the crown of a second truss member mounted upon an opposing pilaster so that the crowns of the truss members are aligned along the longitudinal axis of the building to define the peak of the roof, and said connected means including a flange means extending from the outside of the corner beyond the inside of said corner and a brace means mounted between the two sections inside the corner which is attached to the extended end of said flange means for supporting the truss at said corner, and sheeting means secured to the truss members for enclosing the building over the barrier wall.

12. The building of claim 11 wherein the barrier walls are formed of elongated rectangular shaped members that are stacked one on top of the other and further includes locking means for securing said members to the pilasters.

13. The building of claim 11 wherein each truss member includes a hollow wooden box frame that is covered by plywood panels and wherein the column and the roof beam sections are connected at a corner by a commonly shared elongated flange means that extends inwardly between the sections beyond the inside of said corner.

14. The building of claim 11 that further includes a door means situated between two adjacent pilasters that extends upwardly from the ground to an elevation equal to the elevation of said corner.

15. The building of claim 11 wherein said barrier wall is formed of horizontally disposed beams stacked one on top of the other on the inside of said pilasters and further including locking means anchored in the pilasters that pass through the joints between adjacent beams and being attached to the outside face of the beam members.

16. The building of claim 15 whereby the joint between adjacent beam members includes a tongue carried by one adjacent member which is received in a groove formed in the other adjacent member.

17. The building of claim 16 wherein said beam members are wooden timbers.

18. The building of claim 16 wherein said beam members are cast from concrete.

19. The building of claim 16 wherein each truss member further includes leger strips mounted upon opposite side walls thereof, said strips being parallel with the outside end wall of the truss and recessed inwardly from said end wall a predetermined distance and sheeting units secured to said leger strips.

20. The building of claim 19 wherein each sheeting unit includes an outer board that is seated against the outer wall of adjacent truss members, joist means secured to the back of said board that extends laterally between said adjacent truss members and is seated on leger strips attached to said adjacent truss members, and means to secure the units to the truss members.

21. The building of claim 11 that further includes an air space between the top of the barrier wall and the sheeting means to permit ambient air to enter the building.

22. The building of claim 11 wherein said pilasters are cast concrete elements and which further includes anchor means secured in the top of each pilaster by bolt means that are cast into said pilaster.

* * * * *

UNITED STATES PATENT AND TRADEMARK OFFICE

CERTIFICATE OF CORRECTION

PATENT NO. : 4,862,653

DATED : September 5, 1989

INVENTOR(S) : Patrick G. Pomento

It is certified that error appears in the above-identified patent and that said Letters Patent is hereby corrected as shown below:

Col. 7, line 55, please change "manner" to --means--.

Col. 8, line 53, after "section" insert --that--;

line 55, please delete "that".

Signed and Sealed this

Second Day of October, 1990

*Attest:*

HARRY F. MANBECK, JR.

*Attesting Officer*

*Commissioner of Patents and Trademarks*